US005746352A

United States Patent [19]

Corella

[11] Patent Number: 5,746,352

[45] Date of Patent: May 5, 1998

[54] METERED FLEXIBLE DISPENSING PACKAGE

[76] Inventor: Arthur P. Corella, 8166 Vanscoy Ave., North Hollywood, Calif. 91602

[21] Appl. No.: 651,110

[22] Filed: May 21, 1996

Related U.S. Application Data

[63] Continuation-in-part of Ser. No. 317,186, Oct. 3, 1994, Pat. No. 5,531,358, which is a continuation-in-part of Ser. No. 14,753, Nov. 1, 1993, Pat. No. Des. 354,221.

[51] Int. Cl.[6] ..... B65D 35/08

[52] U.S. Cl. ..... 222/107; 222/158; 222/541.6

[58] Field of Search ..... 222/105, 92, 107, 222/541.1, 541.2, 541.6, 541.9, 207, 215, 158

[56] References Cited

U.S. PATENT DOCUMENTS

| | | | |
|---|---|---|---|
| 2,789,728 | 4/1957 | Britton | 222/107 X |
| 3,184,121 | 5/1965 | Volckening | 222/107 X |
| 3,278,085 | 10/1966 | Brown | 222/107 |
| 3,401,840 | 9/1968 | McConnell et al. | 222/158 |
| 3,473,703 | 10/1969 | Lippincott | 222/215 |
| 4,890,744 | 1/1990 | Lane, Jr. et al. | 222/107 X |
| 4,935,283 | 6/1990 | Jamison | 222/107 X |
| 4,974,732 | 12/1990 | Sullivan et al. | 222/107 X |
| 4,988,016 | 1/1991 | Hawkins et al. | 222/107 X |
| 5,531,358 | 7/1996 | Corella | 222/107 |

*Primary Examiner*—Kevin P. Shaver
*Attorney, Agent, or Firm*—Donald Diamond

[57] ABSTRACT

A first embodiment of a package including superimposed flexible opaque and transparent sides and a circumferential peripheral seal determining an interior sealed enclosure for storing a liquid material includes two contiguous depending seals separated by a preformed slot dividing the enclosure bilaterally into a storage reservoir and a dispensing channel in fluid communication. The dispensing channel includes a closed lower end contiguous to a notch in the peripheral seal. Tearing the package at the notch results in collaterally tearing open the channel lower end and a contiguous portion of the peripheral seal, thereby enabling removal of package contents. Use of a ruled scale imprinted on the opaque side proximate to the dispensing channel and viewing through the transparent side the disposition of material in the channel enable the selection of a measured quantity of material to be expelled from the channel. A second embodiment is identical to the first embodiment except that a continuous divider which is easily torn to define a slot replaces the vertical slot separating the reservoir and channel. A third embodiment is identical to the second embodiment except that a scored line adjacent to the channel lower end enables a flap, formed when the package is torn open, to be folded upwardly where it can be secured to the package, thereby sealing the channel to prevent material leakage.

14 Claims, 2 Drawing Sheets

METERED FLEXIBLE DISPENSING PACKAGE

CROSS-REFERENCE TO RELATED APPLICATIONS

This application is a continuation-in-part of my application Ser. No. 08/317,186 filed Oct. 3, 1994, entitled "Flexible Dispensing Package," now U.S. Pat. No. 5,531,358, which is a continuation-in-part of my design application Ser. No. 29/014,753, filed Nov. 1, 1993, issued on Jan. 10, 1995 as U.S. Pat. No. D354,221 and entitled "Dispensing package with teardrop finger slot." These patents are incorporated herein by this reference.

BACKGROUND OF THE INVENTION

1. Field of the Invention

The present invention relates to dispensing packages. More particularly, the invention relates to a dispensing package having a storage reservoir and a dispensing channel to facilitate removal of the package's contents through a single opening created in the dispensing channel.

2. Description of the Related Art

Today's lifestyle demands convenient, economical and size conscious packaging of materials that are used in everyday life. Availability of small convenient packages is especially relevant to the lifestyle of individuals who frequently travel. Small convenient packages simplify packing luggage. Also, in the event an individual has forgotten certain necessary items, these can be inexpensively provided in hotel rooms. Small packages of liquid soap, shampoo, conditioner, and other viscous fluid materials have been widely manufactured, but are consistently difficult to open and typically are used only a single time. That is, either all contents are removed once a package is opened, or the partially filled package is discarded because, once opened, it becomes too messy to be handled conveniently.

The packaging of liquid products in heat sealable dispensing enclosures by high-speed production techniques and equipment is a well-developed art. Heat sealed, packaged products are generally referred to as having a "form-filled" sealed construction, and are sometimes characterized as "form-and-fill" packages. Such packages can be fabricated in a wide variety of shapes and configurations. For example, three basic pouch configuration types are known as pillow type, three-sided seal type, and four-sided seal type. Pillow type packages are constructed from a single sheet, and are provided with a top and a bottom seal along a vertical seam which can take the form of a thin seal or a lap seal. Three-sided seal type packages are usually formed from a single sheet and include a a top seal, two opposed side seals, and a bottom fold. Four-sided seal type packages are constructed from one or two sheets and include a top seal, a bottom seal, and two opposed side seals.

Single-layer sheets or multi-layer laminate sheets can be used in fabricating heat sealable packages. In either form, oppositely disposed sealable faces generally are comprised of heat sealable thermoplastic materials such as polyethylene or polypropylene. Where laminates are used, the inner layer may be polyethylene, while the outer layer may be cellophane, paper, polyester, metallized polyester, aluminum foil or the like. Heat sealable laminates comprising three or more layers are sometimes referred to as having a "sandwich" structure or configuration.

Use of moderately thick thermoplastic films as heat sealable packaging materials, as well as use of materials such as linear low density polyethylene and high strength polyester in fabricating heat sealable laminates, have resulted in packages with excellent sealing and barrier resistance properties. However, use of these materials often results in packages that are extremely difficult to open. The problem is aggravated when an individual's hands, and particularly, the fingers, are wet or oily. Typically, this problem has been addressed by providing a "starter tear" cut in a peripheral seal of a package. For example, a slot or notch is provided in a peripheral seal to act as a guidance means for tearing open a heat-sealed package. My prior patent, U.S. Pat. No. 4,696,404, is directed to the problem of opening tear-resistant packages, particularly when fingers are wet or oily. The invention provides for a peripherally sealed dispensing package and an inner seal disposed within a central portion of the package. The inner seal includes an aperture extending therethrough which may be used to tear the package open for removal of its contents. The aperture assists in opening the package so that the contents from the main body of the package may be dispensed through two openings created along a sealed edge of the package.

My Prior U.S. Pat. No. 5,531,358 provides a flexible package including an enclosure for storing a material, typically a viscous liquid. The package includes a generally vertical depending seal which divides the enclosure bilaterally into a storage reservoir and a dispensing channel. The channel includes an open upper end and a closed lower end, wherein the upper end is in fluid communication with the reservoir, and the lower end is contiguous to an aperture within the depending seal adapted to be torn open, thereby collaterally tearing open the lower end of the channel and a contiguous portion of the peripheral seal, enabling removal of package contents. By squeezing opposed flexible sides, material is forced from the reservoir into the channel until the channel is filled with a quantity of material. The aperture is torn open by applying force in a downward direction, thereby collaterally tearing open the channel lower end and contiguous portion of the peripheral seal. By squeezing opposed flexible sides of the channel, material is forced from the open lower end of the channel and out of the package. Additional material can be dispensed by again pushing material from the reservoir until the channel is refilled, and then squeezing the material out of the channel.

In many instances users of flexible dispensing packages wish not only to repetitively dispense liquid materials, but also to dispense the material in minute and not necessarily equal quantities. For example, it may be desirable to dispense one or more drops of liquid medicament (such as a medicament for treating acne) onto a finger and then apply it to the skin. Or it may be desirable to dispense droplets of fingerprinting ink, one-by-one, onto a pad. Thus, there is a need for a reliable, inexpensive, and environmentally compatible package which is not limited to a single usage and which can repetitively dispense minute, measurable and measured quantities of material.

OBJECTS OF THE INVENTION

Accordingly, it is an object of the present invention to provide a package for simple, convenient and inexpensive packaging of liquid materials to be dispensed in minute quantities.

Another object of the invention is to provide a package that is easily torn open to produce a single opening at a predetermined location for dispensing package contents.

A further object of the invention is to provide a package having a storage reservoir in fluid communication with a separate and distinct dispensing channel.

Yet another object of the invention is to provide a package capable of repetitively dispensing minute, measurable and measured quantities of fluid in a convenient and reliable manner.

A still further object of the invention is to provide a device that is simple, reliable and easy to use.

One more object of the invention is to provide a device that is simple and inexpensive to manufacture.

Other objects of the invention will become evident when the following description is considered with the accompanying drawings.

SUMMARY OF THE INVENTION

These and other objects of the invention are achieved by providing a package which in a first embodiment includes superimposed flexible sides and a circumferential peripheral seal determining an interior sealed enclosure for storing a material, typically a liquid. The package includes contiguous first and second generally parallel, vertically depending seals, separated by a generally vertical preformed slot dividing the enclosure bilaterally into a storage reservoir portion and a dispensing channel portion in fluid communication via a confluence. The channel includes an open upper end and a closed lower end, wherein the upper end is in fluid communication with the reservoir and the lower end is contiguous to a notch in a side edge of the peripheral seal and to a section of the bottom edge of the peripheral seal. Each depending seal includes an upper portion proximate to the confluence, and a lower portion contiguous to the bottom edge section of the peripheral seal. One flexible side is transparent so that the quantity and disposition of material in the channel and reservoir may be seen. The other flexible side is opaque and includes an outer surface on which are imprinted perimeter outlines of the channel and reservoir disposed so as to generally coincide with the contours of the channel and reservoir. A plurality of lines comprising a scale such as found on rulers are imprinted, transverse and proximate to the channel outer perimeter outline, on the portion of the outer surface between the channel outer perimeter and the proximate package edge. Optionally, numeric indicia may be imprinted at intervals along the scale to faciliate quantifying the amount of material in the channel.

The package is opened by tearing the notch so as to tear open the lower end of the dispensing channel and the contiguous bottom edge section of the peripheral seal. By squeezing the flexible sides at the reservoir portion, material is forced from the reservoir into the channel until the channel is filled with a desired quantity of material as measurable using the scale. By squeezing the flexible sides at the top of the channel, material is forced from the open lower end of the channel and out of the package. Alternatively, the channel may be filled with material and a desired amount expelled by squeezing the channel sides at a position indicated by the corresponding ruled line.

In use, the package is hand-held while material is forced from the reservoir into the channel and then squeezed out of the opened lower end. To more precisely control the quantities of material being transferred from the reservoir to the channel and expelled from the channel, the package may be hung so that the channel lower end is directed upward. This enables gravity to act as a force which inhibits the flow of material unless the package sides are being squeezed. Also, hanging the package in this manner prevents leakage once the lower end is opened.

A second embodiment is identical to the first embodiment except that a divider formed as a linear continuous, scored or perforated seal section which can be easily torn to define a slot replaces the vertical slot between the storage reservoir and dispensing channel portions.

A third embodiment is identical to the second embodiment except that a horizontal scored line is impressed adjacent to the terminus of the dispensing channel. After the package is torn open, the extension of the bottom edge of the peripheral seal below the line may be folded upwardly and secured to the package portion enclosing the dispensing channel lower end, thus preventing leakage of material from the channel.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENTS

Figure 2:
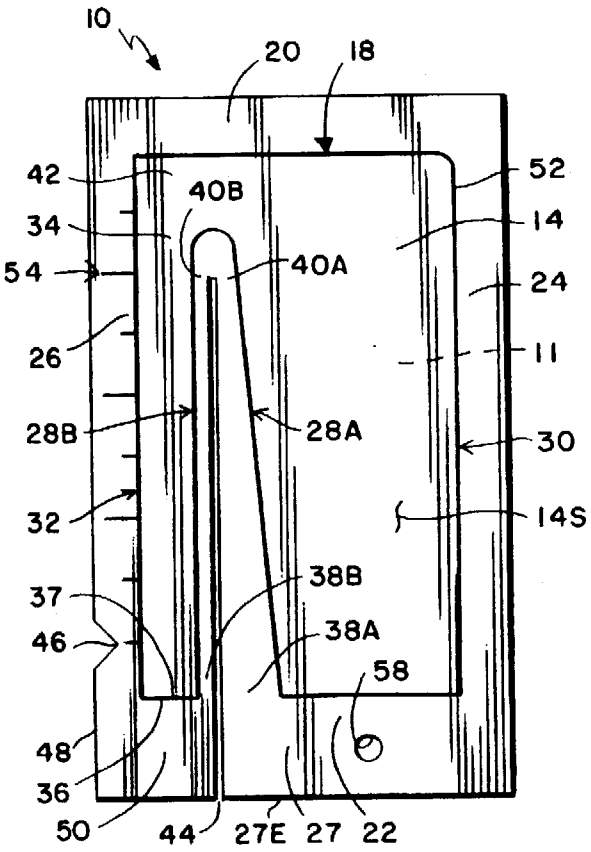
FIG. 2 is a rear elevational view of the FIG. 1 package.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

The invention relates to an article of manufacture which is primarily intended for storing and dispensing fluid materials such as liquid medicaments or fingerprinting ink which need to be dispensed in minute quantities. However, the invention is not limited to particular types of material to be stored and dispensed, and can be used for storing and dispensing any material that can be placed within a subject package, although fluids such as liquid medicaments and fingerprinting ink are preferred.

Figure 1A:
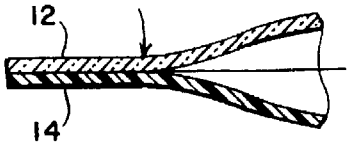
FIG. 1A is an enlarged, partial cross-sectional view taken along the line 1A—1A of FIG. 1.
Figure 1:
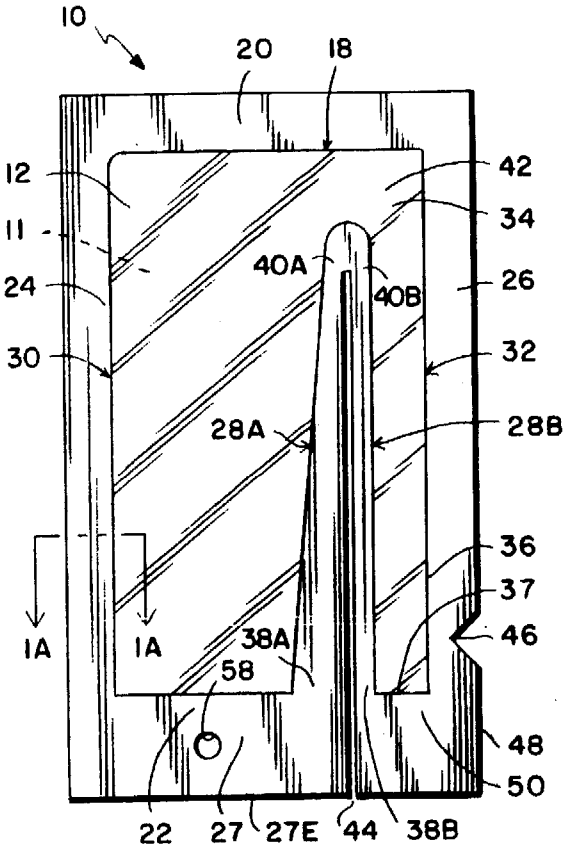
FIG. 1 is a front elevational view of a first preferred embodiment of a flexible dispensing package according to the present invention.

Referring to FIGS. 1 and 2, a first preferred embodiment according to the invention of a package 10 for storing and dispensing liquid medicaments or any similar material 11 is shown. The package is composed of two superimposed plastic sheets (or "sides") 12, 14, which, as shown in FIG. 1A, are bonded together to form a circumferential peripheral seal 16 determining a sealed enclosure 18 between the two sides. Seal 16 includes a sealed top edge 20, a sealed bottom edge 22, and opposed first and second sealed side edges 24, 26. The top edge 20, bottom edge 22, and side edges 24, 26 determine a generally rectangular shape, although the package 10 can be configured to incorporate virtually any shape. Bottom edge 22 extends downwardly into an extension portion 27, formed by continuations of sides 12, 14 fused together, which terminates in an edge 27E.

Sealed bottom edge 22 is connected and generally orthogonal to contiguous, generally longitudinal first and second depending seals (or "weirs") 28A, 28B which separate sealed enclosure 18 into a storage reservoir 30 and a dispensing channel 32 having an open distal end portion 34, and an opposed closed proximal end portion 36 including a terminus 37. Depending seals 28A, 28B, formed by bonding together sides 12 and 14, each have a proximal end portion 38A, 38B, respectively, contiguous with sealed bottom edge 22, and a distal end portion 40A, 40B, respectively, terminating in spaced proximity to a confluence 42 at which reservoir 30 and distal end portion 34 of dispensing channel 32 are in fluid communication. Depending seals 28A, 28B are separated by a preformed slot 44 extending from edge 27E to distal end portions 40A, 40B. Thus, slot 44 bifurcates package 10 into a storage reservoir portion and a dispensing channel portion. (In fabricating package 10, a single broad depending seal may be formed which subsequently can be cut to form depending seals 28A, 28B.)

A notch 46 contiguous to closed end portion 36 and above terminus 37 of dispensing channel 32 is disposed in a section 48 of side edge 26. Notch 46 is also proximate to a section 50 of bottom edge 22. Consequently, a user tearing the package at notch 46 with a downwardly oblique transverse force applied to the notch will open end portion 36 by also tearing through section 50, thereby opening end portion 36 so that a portion of the package contents can be removed.

As shown in FIG. 2, side 14 includes an outer surface 14S on which is imprinted an outline 52 of the perimeter of reservoir 30, confluence 42, and dispensing channel 32. In the preferred embodiment, side 14 is opaque and side 12 is transparent, but side 14 may also be transparent provided that surface 14S is suitable for imprinting. A ruled scale 54 is imprinted on surface 14S proximate to the outline of the dispensing channel. Alternatively, a plurality of numeric indicia 56 (not shown) also may be imprinted along scale 54 to facilitate quantifying the amount of material to be dispensed.

Once the package 10 has been opened, by squeezing flexible sides 12, 14 at the reservoir portion, material is forced from the reservoir into the channel until the channel is filled with a desired quantity of material as viewed through transparent side 12 and measured using scale 54. Then by squeezing the flexible sides at the top of channel 32, material is forced from the open lower end 36 of the channel and out of the package. Alternatively, the channel may be filled with material and a desired amount expelled by squeezing the channel sides at a position indicated by the corresponding ruled line or indicium.

In use, the package is hand-held while material is forced from reservoir 30 into channel 32 and then squeezed out of opened lower end 36. To more precisely control the amounts of material being transferred from the reservoir to the channel and expelled from the channel, the package may be hung from a hole 58 in extension portion 27 so that lower end 36 is disposed upward. This enables gravity to inhibit the flow of material unless the package sides are being squeezed. Also, hanging the package in this manner prevents leakage once end 36 has been opened.

With regard to materials used for package 10, the package preferably is made from a biodegradable material, and preferably is manufactured from a laminate having, for example, a cellophane outer surface. Single-layer sheets or multi-layer laminate sheets can also be used in constructing the package. Where single-layer sheets or multi-layer laminate sheets are used, oppositely disposed sealable faces are generally comprised of heat sealable thermoplastic materials such as polyethylene or polypropylene. Where laminates are used, the inner layer may be polyethylene, while the outer layer can be cellophane, paper, polyester, metallized polyester, aluminum foil or the like. Heat sealable laminates comprising three or more layers, i.e., laminates having a sandwich construction or configuration, can also be used. Selection of a sheet or laminate, and the thickness thereof, are determined by the nature of the material being packaged.

In the preferred embodiment, package 10 is comprised of opposed and superimposed sheets 12, 14. However, the package could be formed from a single transparent sheet circumscribed in a manner to provide a pillow-type configuration, provided that the sheet outer surface is adapted for imprinting.

Figure 3:
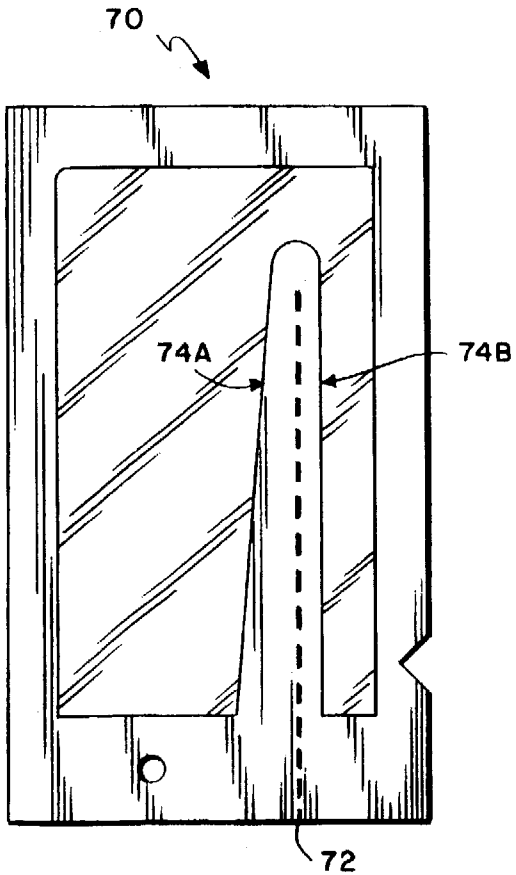
FIG. 3 is a front elevational view of a second embodiment of a flexible dispensing package including a tearable divider.

Referring to FIG. 3, a second embodiment of a package 70 includes a linear, continuous, scored or perforated divider seal section 72 disposed generally vertically between first and second depending seals 74A, 74B. Before package 70 is opened, divider seal section 72 is torn along its length, thus putting package 70 into the configuration of package 10.

Figure 4A:
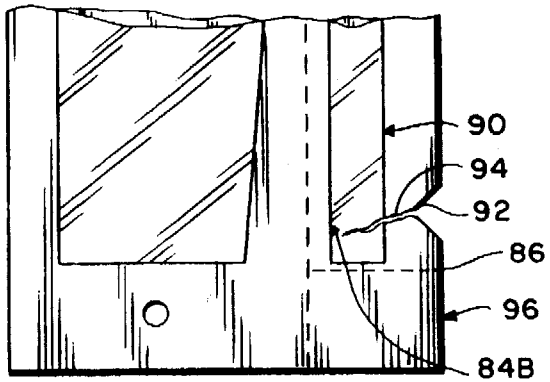
FIG. 4A is a lower front elevational view of the FIG. 4 package after the dispensing channel has been torn open.
Figure 4B:
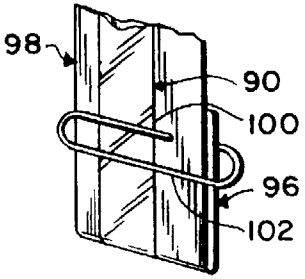
FIG. 4B shows the FIG. 4A foldable seal closed and secured with a paper clip.
Figure 4:
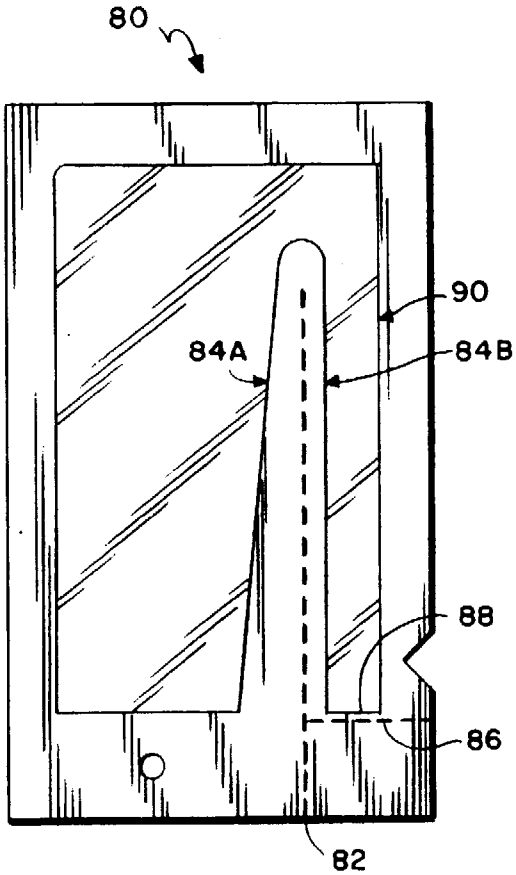
FIG. 4 is a front elevational view of a third embodiment of a flexible dispensing package including a tearable divider and a foldable dispensing channel seal.

Referring to FIG. 4, a third embodiment of a package 80 includes, as in package 70, a linear, continuous, scored or perforated divider seal section 82 disposed generally vertically between first and second depending seals 84A, 84B. Package 80 further includes a scored line 86 impressed horizontally proximate to and below terminus 88 of dispensing channel 90.

Referring to FIG. 4A, by tearing open channel 90 at notch 92 so that resultant slot 94 does not tear through depending seal 84B, the portion of the extension of the bottom edge of the peripheral seal is formed into a flap 96 which is foldable upwardly at line 86. As shown in FIG. 4B, flap 96 may be secured to a package portion 98 enclosing proximal end portion 100 of channel 90 by a paper clip 102 or other similar mechanism, thus preventing material from leaking from end portion 100.

What is claimed is:

1. A dispensing package comprising:

a sealed enclosure determined by superimposed first and second flexible sides and a peripheral seal circumscribing the sides, the seal comprising a top edge, a bottom edge, and opposed first and second side edges;

means for dividing the sealed enclosure into a storage reservoir and a dispensing channel, the dispensing channel including an open distal end portion in fluid communication with the storage reservoir via a confluence, and an opposed closed proximal end portion contiguous to a section of the bottom edge of the peripheral seal and to a section of the second side edge, said dividing means comprising contiguous first and second depending seals determined by a preformed longitudinal divider defining a slot and extending from the bottom edge of the peripheral seal, each depending seal comprising an upper portion and an opposed lower portion, the upper portions being proximate to the confluence, and the lower portions being contiguous to the bottom edge of the peripheral seal;

tear-open means, responsive to force means, for tearing open said sections of the second side edge and bottom edge and the proximal end portion; and measuring means for predetermining a quantity of liquid material to be expelled from the dispensing channel.

2. The package of claim 1, wherein said tear-open means comprises a notch in said second side edge section.

3. The package of claim 2, wherein at least one flexible side is transparent, and at least one flexible side is adapted for imprinting.

4. The package of claim 3, wherein said measuring means comprises a ruled scale imprinted proximate to the dispensing channel.

5. The package of claim 4, wherein the sides are made from a polymeric material.

6. The package of claim 1, further comprising a dispensable material disposed within the sealed enclosure.

7. The package of claim 6, wherein the material is selected from the group consisting of liquid medicament and fingerprinting ink.

8. The package of claim 7, further comprising means for preventing leakage from the opened proximal end portion of the dispensing channel.

9. The package of claim 8, wherein said means for preventing leakage comprises folding upwardly and securing said bottom edge section of the peripheral seal contiguous to said proximal end portion of the storage reservoir.

10. A dispensing package comprising:

a sealed enclosure determined by superimposed first and second flexible sides and a peripheral seal circumscribing the sides, the seal comprising a top edge, a bottom edge, and opposed first and second side edges, the first side formed from a transparent polymeric material, the second side formed from an opaque polymeric material adapted for imprinting;

first and second generally parallel, vertical, contiguous depending seals dividing the enclosure into a storage reservoir and a dispensing channel, the dispensing channel comprising an open distal end portion in fluid communication with the storage reservoir via a confluence, and an opposed closed proximal end portion contiguous to a section of the bottom edge of the peripheral seal and to a section of the second side edge, each depending seal comprising an upper portion and an opposed lower portion, the upper portions proximate to the confluence, the lower portions contiguous to the bottom edge section of the peripheral seal, the depending seals separated by a pre-formed longitudinal slot extending from the bottom edge of the peripheral seal; and a ruled scale imprinted on the opaque side and proximate to the dispensing channel.

11. The package of claim 10, further comprising a notch in said second side edge section.

12. The package of claim 11, further comprising an extension of the bottom edge of the peripheral seal, the extension comprising continuations of the first and second sides, the side continuations fused together, and the extension including a hole.

13. A dispensing package comprising:

a sealed enclosure determined by superimposed first and second flexible sides and a peripheral seal circumscribing the sides, the seal comprising a top edge, a bottom edge, and opposed first and second side edges, the first side formed from a transparent polymeric material, the second side formed from an opaque polymeric material adapted for imprinting;

first and second generally parallel, vertical, contiguous depending seals dividing the enclosure into a storage reservoir and a dispensing channel, the dispensing channel comprising an open distal end portion in fluid communication with the storage reservoir via a confluence, and an opposed closed proximal end portion contiguous to a section of the bottom edge of the peripheral seal and to a section of the second side edge, the second side edge section including a notch, each depending seal comprising an upper portion and an opposed lower portion, the upper portions proximate to the confluence, the lower portions contiguous to the bottom edge section of the peripheral seal, the depending seals separated by a pre-formed slot and separated by a tearable longitudinal seal section extending from the bottom edge of the peripheral seal.

14. A dispensing package comprising:

a sealed enclosure determined by superimposed first and second flexible sides and a peripheral seal circumscribing the sides, the seal comprising a top edge, a bottom edge, and opposed first and second side edges, the first side formed from a transparent polymeric material, the second side formed from an opaque polymeric material adapted for imprinting;

first and second generally parallel, vertical, contiguous depending seals dividing the enclosure into a storage reservoir and a dispensing channel, the dispensing channel comprising an open distal end portion in fluid communication with the storage reservoir via a confluence, and an opposed closed proximal end portion contiguous to a section of the bottom edge of the peripheral seal and to a section of the second side edge, said proximal end portion including a terminus, each depending seal comprising an upper portion and an opposed lower portion, the upper portions proximate to the confluence, the lower portions contiguous to the bottom edge section of the peripheral seal, the depending seals separated by a tearable longitudinal seal section extending from the bottom edge of the peripheral seal seperated by a pre-formed slot and, and a generally horizontal scored line disposed between said terminus and the peripheral seal bottom edge.

* * * * *